US009234305B2

(12) United States Patent
Pollet et al.

(10) Patent No.: US 9,234,305 B2
(45) Date of Patent: Jan. 12, 2016

(54) REINFORCING TEXTILE THREAD FOR AN INFLATABLE SAIL, AND RIGGING SAIL COMPRISING SUCH REINFORCING TEXTILE THREADS

(75) Inventors: Laurence Pollet, Lyons (FR); Cécile Roibet, Pusignan (FR); Sébastien Feraudet, Faverges-de-la-Tour (FR)

(73) Assignee: PORCHER INDUSTRIES, Badinieres (FR)

( * ) Notice: Subject to any disclaimer, the term of this patent is extended or adjusted under 35 U.S.C. 154(b) by 96 days.

(21) Appl. No.: 14/115,083

(22) PCT Filed: May 4, 2012

(86) PCT No.: PCT/EP2012/058238

§ 371 (c)(1),
(2), (4) Date: Mar. 5, 2014

(87) PCT Pub. No.: WO2012/150334

PCT Pub. Date: Nov. 8, 2012

(65) Prior Publication Data

US 2014/0060409 A1 Mar. 6, 2014

(30) Foreign Application Priority Data

May 5, 2011 (FR) ..... 11 53864

(51) Int. Cl.
*D02G 3/40* (2006.01)
*B63H 9/06* (2006.01)

(52) U.S. Cl.
CPC ..... *D02G 3/404* (2013.01); *B63H 9/0614* (2013.01); *B63H 9/0657* (2013.01); *D02G 3/40* (2013.01);

(Continued)

(58) Field of Classification Search
CPC ..... B63H 9/0657; D02G 3/404
USPC ..... 114/102.31; 428/392
See application file for complete search history.

(56) References Cited

U.S. PATENT DOCUMENTS 3,431,962 A 3/1969 Kersker et al.
3,974,989 A * 8/1976 Goodfellow ..... B64B 1/14 244/126

(Continued)

FOREIGN PATENT DOCUMENTS

CN 2590860 Y 12/2003
EP 0 625 417 A1 11/1994

(Continued)

OTHER PUBLICATIONS

International Search Report; issued Jul. 6, 2012, in International Application No. PCT/EP2012/058238.

*Primary Examiner* — Lars A Olson
*Assistant Examiner* — Jovon Hayes
(74) *Attorney, Agent, or Firm* — Hunton & Williams LLP

(57) ABSTRACT

The invention relates to a reinforcing textile thread (82) for an inflatable sail, such as a rigging sail or a flight sail, including a plurality of filaments which are agglutinated so as to form an elongate unitary body (820), and a binder (822) which ensures the cohesion among at least some of the filaments (821) of the unitary body (820), and which consists of a coating material. In order to guarantee an effective, directed reinforcement effect within an inflatable sail without limiting the lifespan of said sail, the unitary body has, in the cross-section thereof, an oblong outline, wherein the ratio of the maximum width (e) of said outline, which corresponds to a thickness of the unitary body, to the maximum length (l) of said outline, which corresponds to a width of the unitary body, is less than 0.06, a plurality of filaments (821) being arranged in series over the thickness of the unitary body.

23 Claims, 2 Drawing Sheets

(52) U.S. Cl.
CPC ... *B63H 2009/0678* (2013.01); *Y10T 428/2918* (2015.01); *Y10T 428/2964* (2015.01); *Y10T 428/2967* (2015.01); *Y10T 428/2969* (2015.01)

(56) References Cited

U.S. PATENT DOCUMENTS

| | | | | | |
|---|---|---|---|---|---|
| 4,454,184 | A * | 6/1984 | Britton | B29C 70/202 | 428/105 |
| 4,702,190 | A * | 10/1987 | Conrad | B63H 9/0657 | 114/102.31 |
| 4,708,080 | A * | 11/1987 | Conrad | B63H 9/0657 | 114/102.31 |
| 5,038,700 | A * | 8/1991 | Conrad | B63H 9/0657 | 114/102.24 |
| 6,074,722 | A * | 6/2000 | Cuccias | B32B 5/26 | 244/31 |
| 6,112,689 | A * | 9/2000 | Baudet | B32B 27/12 | 114/102.31 |
| 6,302,045 | B1 * | 10/2001 | Mahr | B63H 9/0657 | 114/102.33 |
| 6,311,633 | B1 * | 11/2001 | Keire | B32B 27/12 | 114/102.29 |
| 6,332,420 | B1 * | 12/2001 | Rodgers | B32B 5/08 | 114/102.31 |
| 6,382,120 | B1 * | 5/2002 | Keire | B63H 9/0657 | 114/102.29 |
| 7,383,783 | B2 * | 6/2008 | Fiorenzi | B63H 9/06 | 114/102.29 |
| 2003/0111128 | A1 * | 6/2003 | Hannigan | D03D 15/04 | 139/421 |
| 2006/0192054 | A1 * | 8/2006 | Lachenmeier | B64B 1/14 | 244/145 |
| 2007/0218793 | A1 * | 9/2007 | Rossignol | B63H 9/0657 | 442/76 |
| 2013/0075533 | A1 * | 3/2013 | Veran | B64D 17/02 | 244/145 |
| 2014/0060409 | A1 * | 3/2014 | Pollet | B63H 9/0657 | 114/102.31 |

FOREIGN PATENT DOCUMENTS

| | | | | |
|---|---|---|---|---|
| EP | 1 731 641 | a1 | 12/2006 | |
| FR | 2 950 083 | A1 | 3/2011 | |
| JP | 10 273838 | A | 10/1998 | |
| JP | EP 1731641 | A1 * | 12/2006 | D03D 1/0041 |
| JP | 2007 162187 | A | 6/2007 | |
| WO | WO 94/11185 | A1 | 5/1994 | |
| WO | WO 96/28258 | A1 | 9/1996 | |
| WO | WO 2005/070759 | A1 | 8/2005 | |

* cited by examiner

REINFORCING TEXTILE THREAD FOR AN INFLATABLE SAIL, AND RIGGING SAIL COMPRISING SUCH REINFORCING TEXTILE THREADS

BACKGROUND OF THE INVENTION

The present invention relates to a reinforcing textile thread for an inflatable sail, such as a rigging sail or a flight sail. It also relates to a rigging sail, in particular a mainsail, including at least one reinforcing textile thread.

On a sailboat, the mainsail is generally the lowest sail of the mainmast, and the most expansive when it is fully deployed. For some time, this sail was made from a taffeta weave from polyester threads. Recently, in particular in the field of competition rigging equipment, it has been proposed to replace the taffeta weave with lighter complexes that are stronger and transmit the propulsion forces from the wind more effectively. These complexes typically assume the form of a member including two films of a plastic material, which are glued to each other, trapping a reinforcing grid between them. This grid is formed by a set of threads, arranged in a regular pattern, such as a diamond or a square, which, by repetition, defines the entire grid. This means that the grid is a two-dimensional assembly of threads, often a weave, with which a main rectilinear direction and another rectilinear direction, for example perpendicular to the preceding, can be associated, both belonging to the plane of the grid. This structure gives the grid tear strength and, more generally, an ability to mechanically strengthen the two side-by-side films of the complex, with properties that are not generally identical in all directions of the plane, but which are pre-established relative to the aforementioned main direction, based on the pattern of the grid.

Inasmuch as within a sail, in particular a mainsail, service constraints are established based on curved lines of action, which generally connect the apices and/or edges of the sail in pairs, the aforementioned grid is biased, within the complex, in changing directions relative to the main direction of the grid, with local risks of damaging the complex. To strengthen the complex, it is known to add, inserted between the two films, multiple individual reinforcing threads, which are respectively oriented within the complex along predetermined lines of action such that, during use, the strains undergone by the sail are essentially or almost exclusively borne by those reinforcing threads, which are dimensioned accordingly to sustain the mechanical strength of the sail, while the other layers making up the sail, i.e., the two films and the grid, may then be dimensioned minimally in terms of mechanical strength: the overall weight of the sail is decreased as a result. In practice, the individual reinforcing threads generally used are made from aramid, carbon or polyester.

That being said, the use of these individual reinforcing threads causes practical problems. Given their non-negligible thickness relative to the thicknesses of the other components of the complex, these threads create significant relief discontinuities: in the long-term, these discontinuities are the beginning of delamination of the complex, as well as areas of wear of the complex due to friction with the wind. These drawbacks are even more pronounced in the apices of the sail, where the end parts of a large number of these threads are concentrated and superimposed on each other, if applicable while allowing free spaces to remain between them, not occupied by the films or by the glue of the complex. The lifespan of the sail is then limited as a result.

Similar technical considerations exist for rigging sails other than the mainsail, or even for other types of sails inflatable by the wind, such as flight sails, which are, inter alia, kite surf sails, paragliding sails, etc., when efforts are made to reinforce such inflatable sails using directed reinforcing individual threads.

To avoid the aforementioned drawbacks relative to individual reinforcing threads, WO-A-94/11185 proposed to replace those individual threads with bands each made up of multiple parallel monofilaments, which, in the matrix binding them to each other, are arranged in a single layer, the thickness of which is equal to the diameter, typically smaller than 20 μm, of the monofilaments. The sail obtained thus includes several of these bands such that the monofilaments of each of them extend in respective directions that are inclined relative to one another: within the complex making up this sail, the interlacing monofilament density is increased as a result. This solution is attractive on paper, but is particularly difficult to implement, as it requires manufacturing, in particular by pultrusion, the bands described above, having a thickness of a single monofilament. Furthermore, this solution requires that each of the bands occupies the entire expanse of the complex, thereby representing part of the total thickness of the complex, the flexibility of which is deteriorated as a result: consequently, it is necessary to provide as many bands as there are directions of lines of action to be reinforced, without, furthermore, being able to reinforce a line of action with a curved profile continuously.

Furthermore, in a field remote from inflatable sails, EP-A-0,625,417 discloses a reinforcing thread that includes a sheath, inside which filaments run in a powder. The aerated structure of this powder is used to impart considerable flexibility to the thread. In practice, this reinforcing thread cannot be used within a complex with laminated outer films.

The aim of the present invention is to propose individual reinforcing threads which, while guaranteeing an effective directed reinforcing effect for an inflatable sail, does not limit the lifespan thereof, in particular without causing premature wear thereof.

SUMMARY OF THE INVENTION

The present invention relates in part to a reinforcing textile thread for an inflatable sail, such as a rigging sail or a flight sail, comprising multiple filaments, which are agglutinated to form an elongated unitary body, and a cohesion binder between at least some of the filaments of the unitary body, which is made up of a coating material, wherein, in transverse cross-section, the unitary body has an oblong shape whereof the ratio between its maximum width, which corresponds to a thickness of the unitary body, and its maximum length, which corresponds to a width of the unitary body, is smaller than 0.06, and several filaments succeed each other over the thickness of the unitary body.

The present invention also relates to a rigging sail, which includes two films made from a plastic material, which are laminated to each other and between which are inserted, in a superposition direction defined by the thickness of the films, both a reinforcing grid, which has a pre-established repetition pattern, and at least one individual reinforcing textile thread as discussed above, which is oriented along a pre-determined line of action, wherein the at least one reinforcing thread is arranged such that, in transverse cross-section, the width of the oblong shape of its unitary body extends along the superposition direction.

DETAILED DESCRIPTION OF THE INVENTION

Figure 1:
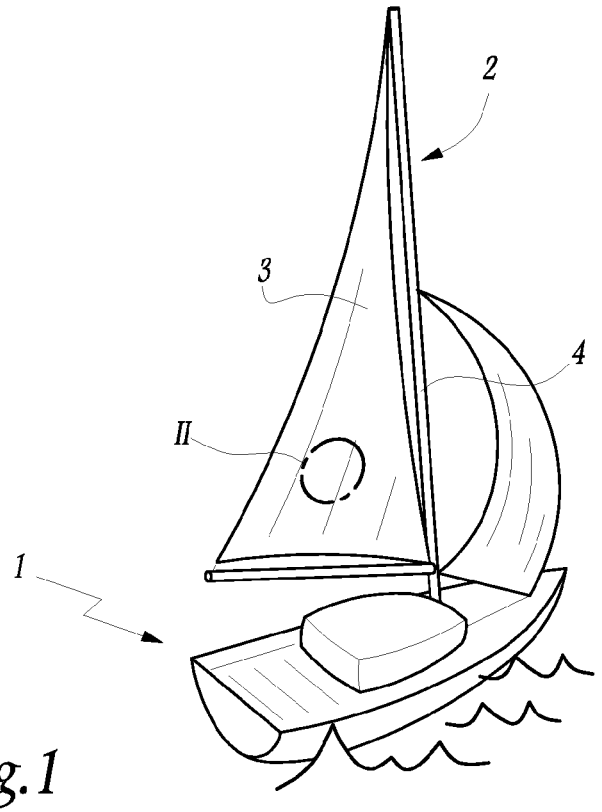
FIG. 1 is a diagrammatic perspective view of a sail boat equipped with a rigging according to the invention.

The present invention relates in part to a reinforcing textile thread 81, 82, 83 for an inflatable sail, such as a rigging sail 3 or a flight sail, comprising multiple filaments 821, which are agglutinated to form an elongated unitary body 820, and a cohesion binder 822 between at least some of the filaments 821 of the unitary body 820, which is made up of a coating material, wherein, in transverse cross-section, the unitary body 820 has an oblong shape whereof the ratio between its maximum width (e), which corresponds to a thickness of the unitary body, and its maximum length (l), which corresponds to a width of the unitary body, is smaller than 0.06, and several filaments 821 succeeding each other over the thickness of the unitary body.

The present invention also relates to a rigging sail 3, which includes two films 5, 6 made from a plastic material, which are laminated to each other and between which are inserted, in a superposition direction (Z) defined by the thickness of the films, both a reinforcing grid 7, which has a pre-established repetition pattern, and at least one individual reinforcing textile thread 81, 82, 83 as discussed above, which is oriented along a pre-determined line of action, wherein the at least one reinforcing thread 81, 82, 83 is arranged such that, in transverse cross-section, the width (e) of the oblong shape of its unitary body 820 extends along the superposition direction (Z).

One of the ideas at the base of the invention is not to use individual reinforcing threads with a round or nearly circular transverse section, but to use reinforcing threads that can be described as flat or flattened. Thus, the reinforcing thread according to the invention has an oblong transverse section, i.e., a transverse section that is longer than it is wide, whereof the width, in other words the thickness of the thread when the latter is considered within an inflatable sail, in particular within the rigging sail according to the invention, is less than 0.06 times its length, i.e., 0.06 times the width of the thread when the latter is considered within the inflatable sail, with the understanding that the length of the aforementioned thread corresponds to the dimension of that thread along its longitudinal direction within the inflatable sail. Owing to their flat configuration, the individual reinforcing threads according to the invention do not cause a significant variation in the total thickness of the inflatable sail, inasmuch as the small variation of the thickness, in the areas where at least one of those threads extends, is accommodated by the rest of the inflatable sail, in particular by the two plastic films of the rigging sail according to the invention, without risk of delamination between those films. The flat threads also have the advantage of giving the inflatable sail considerable flexibility, while avoiding stiffening it locally. Furthermore, the outer relief of the inflatable sail, resulting from the presence of the flat reinforcing threads, is not very pronounced, or practically nonexistent, which creates only very little, or practically no resistance by friction for the wind. Additionally, even in regions of the inflatable sail where two or even more flat reinforcing threads are superimposed, for example the apices of the rigging sail according to the invention, the cumulative thickness of the components of the inflatable sail remains moderate: thus, the cohesion between the different reinforcing threads and the grid is maintained without discontinuity of the material by the two laminated films of the rigging sail according to the invention.

In practice, various methods for manufacturing a reinforcing thread according to the invention, as well as various methods for manufacturing the inflatable sail incorporating such reinforcing threads, can be considered by specialists in the field, without going beyond the scope of the present invention. The same is true for the materials making up the various components of the inflatable sail, in particular the materials making up its reinforcing threads.

The invention also relates to a rigging which includes a rigging sail 3 as discussed above.

Figure 2:
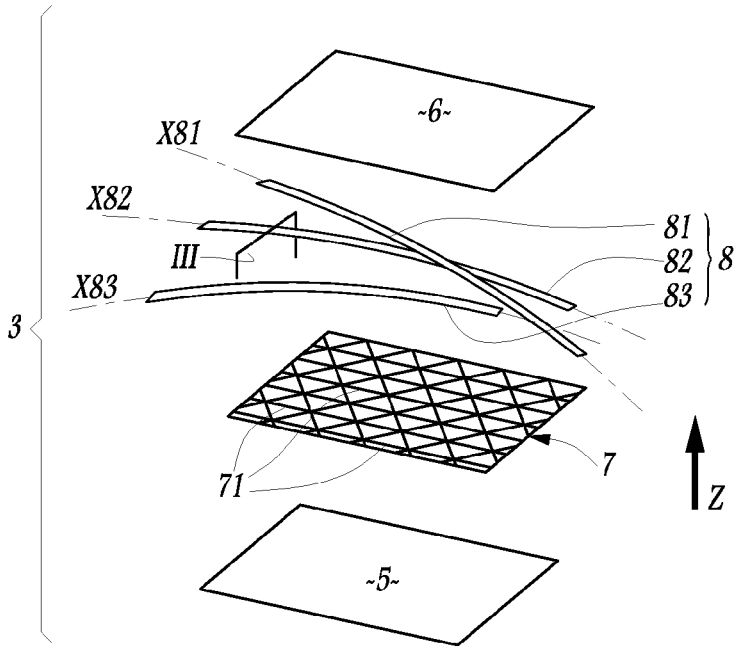
FIG. 2 is an exploded diagrammatic perspective view, showing the components of the sail area circled II in FIG. 1.
Figure 3:
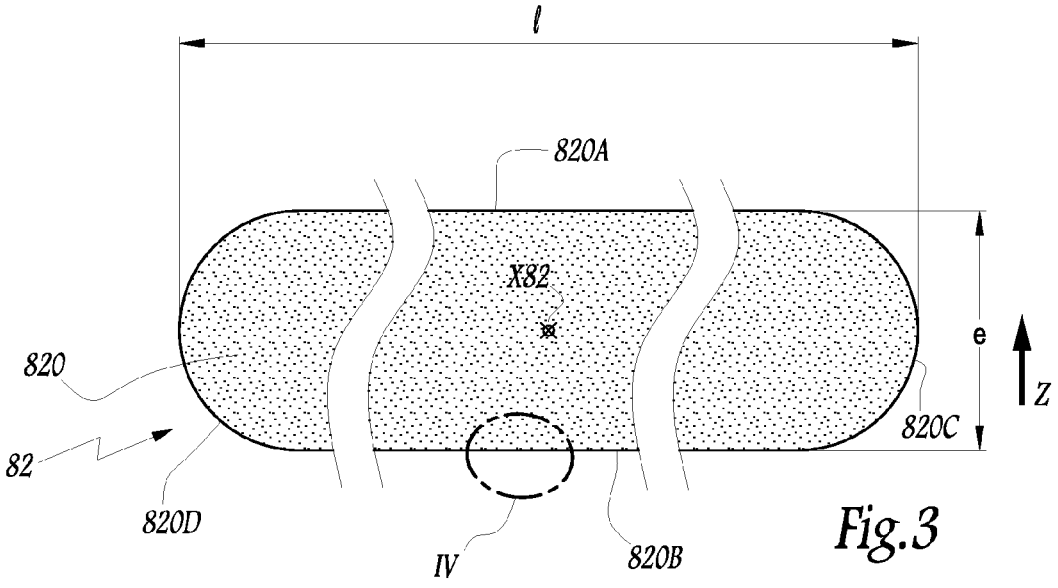
FIG. 3 is a diagrammatic cross-section along plane III of FIG. 2.
Figure 4:
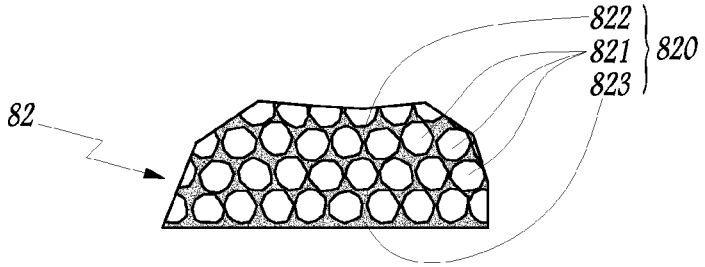
FIG. 4 is an enlarged diagrammatic view of the area circled IV in FIG. 3.
Figure 5:
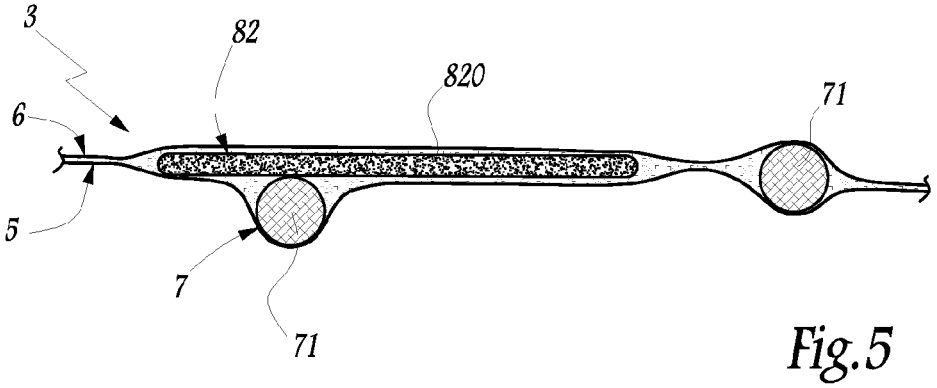
FIG. 5 is a partial diagrammatic view of the sail, in the assembled state, of FIG. 2.

FIG. 1 is a diagrammatic perspective view of a sail boat equipped with a rigging according to the invention;

FIG. 2 is an exploded diagrammatic perspective view, showing the components of the sail area circled II in FIG. 1;

FIG. 3 is a diagrammatic cross-section along plane III of FIG. 2;

FIG. 4 is an enlarged diagrammatic view of the area circled IV in FIG. 3; and FIG. 5 is a partial diagrammatic view of the sail, in the assembled state, of FIG. 2.

FIG. 1 shows a sailboat 1 whereof the rigging 2 comprises, inter alia, a mainsail 3 connected to a mast 4 belonging to the rigging 2, typically by cords not shown in FIG. 1.

As very diagrammatically shown in FIG. 2, the mainsail 3 is made up of a fabric complex, corresponding to the superposition of several layers secured to each other. In practice, it will be noted that the mainsail 3 may be made in a single complex part or, more frequently, the mainsail is made up of several complex segments, individually worked flat, then assembled to each other to jointly form the mainsail. As clearly shown in FIG. 2, the complex of the mainsail 3 comprises at least four superimposed layers, i.e., two opposite films 5 and 6, making up the two opposite faces of the mainsail, as well as, between said films 5 and 6, a grid 7 and a layer 8 made up of multiple individual threads, of which there are three in the example shown in FIG. 2, respectively referenced 81, 82 and 83. In FIG. 2, Z denotes the rectilinear direction corresponding to the thickness of the complex of the mainsail 3: thus, the film 5, the grid 7, the layer 8 of threads 81, 82 and 83, and the film 6 succeed one another in that superposition direction Z. In the assembled state of the complex of the mainsail 3, whereas said complex is stretched flat on the planar surface, the various component layers of the complex generally extend in a plane perpendicular to the direction Z.

Of course, during use, i.e., when the mainsail 3 is inflated by the wind so as to propel the sailboat 1, the complex generally has a three-dimensional geometry, with a more or less curved shape.

The films 5 and 6 are made from a plastic material, having noted that in practice, the same plastic material is used for both films. As one non-limiting example, the aforementioned plastic material is polyester, advantageously treated for ultraviolet degradation: it may particularly be polyethylene terephthalate (PET), if applicable mixed with a fluoropolymer of the PVDF type, such as vinylidene polyfluoride. Also as a non-limiting example, the thickness of each film 5, 6 is typically approximately 10 μm, for example comprised between 5 and 50 μm.

The grid 7 comprises, or as in the example embodiment considered in the figures consists of, an assembly of rectilinear threads 71 arranged relative to one another while repeating a pre-established elementary pattern regularly in the plane of the grid 7. Thus, in the example embodiment considered in FIG. 2, this pattern consists of a diamond completed by one of its diagonals. In other words, by regular repetition of the aforementioned pattern, in the two directions defined by the plane of the grid 7, the entirety of that grid is obtained. Thus, the different threads 71 making up the grid 7 are positioned relative to one another following a pre-established geometry, both in terms of relative orientation and relative spacing in the plane of the grid.

As a non-limiting example, the threads 71 are made from a polyester, aramid, carbon, etc. Furthermore, within the same grid 7, threads 71 made from different respective materials and with different respective titers may be mixed.

According to one preferred embodiment, the threads 71 of the grid 7 are interlaced like a fabric with some of the threads acting as weft threads, while others threads act as warp threads. Alternatively, the threads 71 do not interlace, but are superimposed on each other, while being distributed in at least two superimposed plies. If applicable, the threads 71 are glued or welded to each other at their interlacings or their intersections. As a detailed example, the reader may see document EP-A-1,111,114.

The thickness of the grid 7 is equal to the thickness of the threads 71, for most of that grid, with the exception of the quasi-periodic areas where at least two of the threads 71 interlace or intersect, while overlapping in the direction Z, in which areas the thickness of the grid 7 is locally increased at most by as many times as there are threads 71 that overlap each other. As a non-limiting example, the thickness of the threads 71, and therefore the thickness of the grid 7, outside the overlapping areas of several threads 71, may be approximately one or several hundred micrometers, or even more, based on the titer of the threads 71.

Within the context of the mainsail 3, the grid 7 serves to mechanically strengthen the side-by-side films 5 and 6, typically by increasing the tear strength of the complex. More generally, as explained in the introduction of this document, the interlacing of the threads 71 gives the grid 7 mechanical strength properties, which are different based on the direction in the plane of the grid, as a function of the geometry of the elementary pattern of that interlacing.

Unlike the threads 71 of the grid 7, the threads 81, 82 and 83 of the layer 8 are individual threads, inasmuch as, before assembly of the complex of the mainsail 3, these threads 81, 82 and 83 are mechanically independent of each other. Within the complex of the mainsail 3, the threads 81, 82 and 83 serve to reinforce that complex, while being oriented along predetermined planes of action and, in particular, curved lines of action: thus, each of the threads 81, 82 and 83 extends lengthwise, in the plane of the complex of the mainsail 3, in a unique longitudinal direction X81, X82 and X83, if applicable curved, as shown in FIG. 2. In a manner known in itself, each of these threads 81, 82, 83 thus follows a preset path along its longitudinal direction X81, X82, X83, along which path it has been predetermined, in particular through ad hoc prior calculations, that significant strains will be applied to the complex of the mainsail 3 when that mainsail is in use, in particular at a given bearing. Thus, as explained in the introduction of this document, the strains applied to the complex of the mainsail 3 are then borne, for the most part, or even practically entirely, by one or more of the threads 81, 82 and 83, which is dimensioned accordingly. The advantage is then that other components of the complex, which are the films 5 and 6 and the grid 7, can be dimensioned minimally in terms of mechanical strength, which, inter alia, decreases the overall weight of the mainsail 3. As a non-limiting example, at least some of the aforementioned lines of action connect the apices of the mainsail 3 in pairs, in a curved manner in the plane of the complex of said mainsail.

A more detailed description of the thread 82 will be provided below, in particular in light of FIGS. 3 to 5, with the understanding that the considerations that follow apply to the other threads 81 and 83 of the layer 8. Of course, it will be understood that, in practice, this total number of reinforcing threads, similar to the threads 81, 82 and 83, within the complex of the mainsail 3 is also generally larger than three.

Thus, the thread 82 comprises, or as in the example considered here even consists of, a unitary body 820 that extends lengthwise along the direction X82, while being substantially centered on an axis geometrically embodying the direction X82.

As clearly shown in FIG. 3, the thread 82 does not have, in cross-section transverse to its longitudinal direction X82, a circular profile or even a nearly circular profile, as could be expected for a reinforcing textile thread traditionally used in the field considered here. On the contrary, the transverse section of the unitary body 820 of the thread 82, i.e., its section in a geometric plane perpendicular to its longitudinal direction X82, has an oblong shape, i.e., a shape significantly longer than it is wide. Considering the thread 82 based on its overall volume, this means that the body 820 has a width substantially larger than its thickness, having agreed that the thickness of the thread is its dimension considered in the direction Z, while its width is its dimension which, in the plane of the complex of the mainsail 3, is perpendicular to the longitudinal direction X82. Thus, in FIG. 3, l denotes the length of the oblong section of the unitary body 820 of the thread 82, while e denotes the width of the oblong section, in reference to the width and the thickness of the thread 82, respectively. Of course, by definition, the width l of the thread 82 is significantly smaller than the corresponding dimension of the films 5 and 6, such that, in the assembled state of the complex making up the mainsail 3, the thread does not cover the entire surface across from each of the films 5 and 6, but on the contrary only covers a limited fraction thereof, which ensures good flexibility for the complex.

Thus, the thread 82 may be described as a flat or flattened thread, which, within the meaning of the present document, consists of providing that the ratio e/l between its thickness and its width, i.e., the ratio between the maximum width and the length of the oblong section of its unitary body 820, is smaller than 0.06, or even preferably smaller than 0.05.

In practice, the flat or flattened shape of the unitary body 820 of the thread 82 is related to the composition of that unitary body. In fact, as shown diagrammatically in FIG. 4, the body 820 is not a single-unit piece, but results from the agglutination of a large number of elementary filaments 821: each of these filaments 821 may be separated individually from the others and, in that sense, may therefore be described as a monofilament. Individually, it is possible to consider that each of these filaments 821 has a substantially circular section in cross-section transverse to the axis X82, with a diameter of approximately several tens of micrometers, in particular comprised between 3 and 30 μm. When these filaments 821 are considered in the agglutinated state within the unitary body 820, these filaments 821 are arranged relative to one another to give said unitary body 820 the oblong section described above, having noted that several hundred, or even one or more thousand filaments, in other words at least 200, or at least 1000 filaments, are thus agglutinated to form the unitary body 820. As a result, the thickness e of the unitary body 820 is greater than 50 μm, while in particular being approximately 1/10 of a millimeter, which means that, in the direction Z, several filaments 821, in particular one, approximately ten filaments 821, or even several tens of filaments 821 succeed each other over the thickness of the unitary body 820. More precise quantitative examples will be given at the very end of this description.

According to preferred embodiments, the filaments 821 are made either from an organic material, in particular aramid, polyamide, polyester, in particular aromatic polyester, such as VECTRAN (registered trademark), or polyethylene, in particular high-density polyethylene (HDPE) or polyethylene naphthalate (PEN), such as PENTEX (registered trademark), or a mineral material, in particular carbon or glass.

According to the embodiment shown in FIGS. 3 and 4, the unitary body 820 of the thread 82 is glued, in the core, and advantageously outwardly. More specifically, as diagrammatically shown in FIG. 4, glue, or more generally a coating material, is provided inserted between the filaments 821, thus forming a cohesion binder 822 between said filaments. Furthermore, a coating material is advantageously provided so as to surround the filaments 821 situated at the periphery of the unitary body 820, so as to form a sheath 823 coating that body 820. Although, as a non-illustrated alternative, only the binder 822 is in fact present, that binder 822 and the sheath 823 are advantageously associated, while in practice being made up of the same component glue, in particular applied by gluing, more generally by coating.

The binder 822 and the sheath 823 participate in keeping the filaments 821 in place within the unitary body 820. Additionally, the binder 822 specifically serves to limit, or even prevent infiltrations of water in the unitary body 820 by capillarity. The specific additional function of the sheath 823 is to facilitate use of the thread 82, in particular by allowing it to be wound and/or by improving its physicochemical integration within the complex of the mainsail 3, as mentioned later.

The coating material(s) used to form the binder 822 and the sheath 823 are advantageously polymer-based, in particular acrylic-, polyurethane- or polyethylene-based. Specific glue references that can be used are provided at the very end of the description. In an embodiment, the sheath 823 is made up of a coating material that is identical to the coating material of the cohesion binder 822.

Due to the presence of the binder 822 and, advantageously, the sheath 823, part of the mass of the unitary body 820 comes from the coating material making up said binder and, if applicable, said sheath. It is thus possible to define a coating level of the unitary body 820, which is defined as 100 times the ratio between the difference between the titer of the coated thread and the titer of the non-coated thread, on the one hand, and the titer of the non-coated thread on the other hand. In practice, this coating level is comprised between 5 and 100%. It is preferably below 50%, for reasons in particular related to the final weight of the complex of the mainsail 3.

In practice, various geometries may be considered for the transverse section of the unitary body 820, once those geometries have an oblong shape or outline. Thus, in the embodiment diagrammatically illustrated in FIG. 3, the shape or outline of the transverse section of the unitary body 820 has two opposite segments 820A and 820B that are substantially flat, between which the width of its shape is defined, in other words, the thickness e of the unitary body 820. This means that the segments 820A and 820B extend substantially perpendicular to the direction Z, while being separated by the distance e. The respective ends of these flat segments 820A and 820B are connected in pairs by two opposite segments 820C and 820D of the transverse shape of the unitary body 820, said segments 820C and 820D being convex, in particular by continuously connecting the flat segments 820A and 820B. Of course, the segments 820A and 820B are not strictly flat, inasmuch as they are defined by a series of filaments 821 situated at the periphery of the unitary body 820, if applicable while being coated by a portion of the sheath 823. This embodiment has the advantage that the thickness e of the unitary body 820 has a substantially constant value over most of the width of the body, in particular without having a local maximum value along the direction of the width of the body 820. This means that the flat or flattened shape according to the invention is thus optimized.

That being said, as an alternative that is not shown, the oblong shape of the transverse cross-section of the unitary body 820 may substantially correspond to an ellipse or, more generally, to a substantially elliptical shape, which is centered on an axis geometrically embodying the direction X82 and the small axis of which extends along the direction Z. In that case, the ratio between the maximum width and the maximum length of that outline corresponds to the ratio between the small radius and the large radius of the elliptical shape.

More generally, geometries other than those mentioned above can be considered for the transverse oblong shape of the unitary body 820.

According to one advantageous aspect, in the case where the filaments 821 are made from aramid, the ratio between the titer of the thread 82 and the width l of its unitary body 820 is provided to be below a predetermined value. This means, for a given thread titer, that a thickness e is provided of the unitary body 820 that is small enough for the filaments 821 of that body to be distributed over a large width l. Thus, the aforementioned ratio is advantageously provided to be less than 1000 (one thousand), expressing the titer of the non-coated unitary body 820 in dTex and expressing its width l, i.e., the length of its oblong shape, in millimeters.

As mentioned above, various methods may be considered to manufacture the thread 82.

As an example, one of these methods consists of starting from a pre-existing thread with a substantially circular section, then subjecting it to one or more flattening operations, if applicable accompanied by coating operations, in particular gluing operations, so as to arrive at the structure of the thread 82 shown in detail above. For a detailed example of the coating, the reader may refer to document US-A-2010/0089017. Alternatively, the thread 82 may be manufactured directly from filaments 821, in particular by arranging them relative to one another to obtain the structure described above. In all cases, a flattened or flat thread is available, advantageously capable of being wound and stored for subsequent use, in particular to manufacture the complex of the mainsail 3.

Likewise, the manufacturing of the complex of the mainsail 3, i.e., the assembly of the films 5 and 6, the grid 7 and the threads 81, 82 and 83, may be done using various methods. As an example, starting from the film 5, the grid 7, for example coming from a coil, and the threads 81, 82 and 83, the latter in particular being obtained by cutting from a thread coil like that mentioned in the previous paragraph, then the film 6 is attached on the semi-complex thus formed, in order to obtain the complete complex.

Alternatively, the grid 7 and the threads 81, 82 and 83 are initially pre-positioned between the films 5 and 6, before forcing the joining of those films, in particular by creating a vacuum between them. The films 5 and 6 are maintained relative to one another using any suitable means, in particular by gluing, the glue being able to be provided outwardly or to be integrated into one and/or the other of the films. Advantageously, this glue effectively binds to the sheath 823.

In all cases, at the end of the manufacturing method, the complex of the mainsail 3 has the diagrammatic configuration of FIG. 5, with, inter alia, the threads 71 of the grid 7 and the thread 82 trapped between the films 5 and 6. This diagrammatic illustration of FIG. 5 clearly shows that the presence of the thread 82 does not cause a significant relief discontinuity for the complex, in particular compared to the threads 71 of the grid 7. In particular, even when the method for manufacturing the grid 7 and/or the method for manufacturing the complex tend to elongate the transverse section of the threads 71, by slightly crushing the latter in the direction Z, the oblong shape of the transverse section of the thread 82 differs clearly from the transverse section of the threads 71, inasmuch as, at substantially identical respective titers for the threads 71 and threads 82, the thickness e of the unitary body 820 of the thread 82 is advantageously at least two times smaller than that of the threads 71 of the grid 7 in the direction Z.

It will be noted that, in light of the flattened or flat shape of the threads 81, 82 or 83 before they are assembled to the rest of the complex of the mainsail 3, the maximum thickness e, in other words the maximum width of their oblong transverse shape, is not modified during manufacturing of the complex, except in marginal, insignificant proportions with respect to the dimensions of the unitary body 820, in particular with respect to the ratio e/l. Additionally, as mentioned above, several of the threads 81, 82 and 83 may be partially superimposed in the direction Z: such a superposition results from tracing the lines of action along which those threads run, respectively. This is typically the case at the apices of the mainsail 3.

Before presenting specific example embodiments below, it will be noted that various developments and alternatives of the complex of the mainsail 3, in particular the reinforcing threads 81, 82 and 83, may be considered:

For example, the complex of the mainsail 3 may include at least one additional layer, in the form of a taffeta weave, corresponding to a polyester fabric, for example from 40 to 90 g/m$^2$; in practice, this additional taffeta weave layer is either inserted between the films 5 and 6, in any insertion position with respect to the grid 7 and the layer of reinforcing threads 8, or attached as an additional layer to one and/or the other of the films 5 and 6; in any case, this or these additional taffeta weave layer(s) make the complex of the mainsail 3 heavier, but give it a more traditional aesthetic, i.e., an aesthetic recalling mainsails made up exclusively of such a polyester fabric;

At the apices of the mainsail 3, additional fabric pieces may be attached superimposed on the complex, for local reinforcement purposes;

Of course, rigging sails other than the mainsail 3, such as a spinnaker or gennaker, may be made from a complex as described thus far; and/or The individual directed reinforcing threads described thus far, such as the threads 81, 82 and 83, may be integrated into inflatable sails other than rigging sails, inasmuch as such inflatable sails make it possible, under the action of the wind or a gas, to produce a traction or suspension effect with respect to a body connected to the inflatable sail; in particular, this advantageously relates to flight sails, such as paragliding, kite surf, hang gliding, kite flying, parachute, inflatable wall, etc. sails.

EXAMPLE EMBODIMENTS

Example 1 reinforcing thread 81, 82, 83, which includes 2000 filaments made from aramid, more specifically KEVLAR (registered trademark), which has a titer of 3300 dTex, which is coated at 30% with an acrylic glue, such as the glue marketed under the reference "UCECOAT DW 3134" by the company CYTEC, and which has a width l equal to 4 mm and maximum thickness e equal to 0.1 mm.

Using a TABER stiffness tester, it is measured that this thread has a stiffness of 8.8 TABER stiffness units, or 0.8 TSU ("Taber Stiffness Units", corresponding to reference units), the measurements being done on test pieces of three threads measuring 3 cm long and with a deflection angle of 15%. This measurement translates great flexibility for the thread of Example 1, in particular in comparison to a thread having the same components but a substantially round section, the stiffness of which was measured at 56.6 Taber stiffness units, i.e., 5 TSU.

Example 2 reinforcing thread 81, 82, 83, which includes 1000 aramid filaments, which has a titer of 1680 dTex, which is coated at 30% with a glue of the polyester-polyurethane type, such as the glue marketed under the reference "PRIMAL NW-1845K" by the company ROHM-AND-HAAS, and which has a width l equal to 2.7 mm and maximum thickness e equal to 0.1 mm.

Example 3 reinforcing thread 81, 82, 83, which comprises polyester filaments, more specifically VECTRAN (registered trademark), which has a titer of 2530 dTex, which is coated at 21% with an acrylic glue, such as that marketed under the reference "PRIMAL E 941P" by the company ROHM-AND-HAAS and which has a width/equal to 2.7 mm and a thickness e equal to 0.16 mm.

Example 4 reinforcing thread 81, 82, 83, which comprises carbon filaments, which has a titer of 8200 dTex, which is coated at 25% with a polyether-polyurethane glue, such as the glue marketed under the reference "IMPRANIL LP RSC 4002" by the company BAYER, and which has a width l equal to 5 mm and a thickness e equal to 0.18 mm.

The invention claimed is:

1. A reinforcing textile thread for an inflatable sail, comprising multiple filaments, which are agglutinated to form an elongated unitary body, and a cohesion binder between at least some of the filaments of the unitary body, which is made up of a coating material, wherein, in transverse cross-section, the unitary body has an oblong shape whereof the ratio between its maximum width, which corresponds to a thickness of the unitary body, and its maximum length, which corresponds to a width of the unitary body, is smaller than 0.06, and several filaments succeed each other over the thickness of the unitary body.

2. The thread according to claim 1, wherein thickness of the unitary body is greater than 50 μm.

3. The thread according to claim 1, wherein approximately ten filaments succeed each other over the thickness of the unitary body.

4. The thread according to claim 1, wherein several tens of filaments succeed each other over the thickness of the unitary body.

5. The thread according to claim 1, wherein the thread further comprises a sheath for coating the unitary body.

6. The thread according to claim 5, wherein the sheath is made up of a coating material that is identical to the coating material of the cohesion binder.

7. The thread according to claim 5, wherein the coating material making up the sheath is polymer based.

8. The thread according to claim 1, wherein the oblong shape of the unitary body has two substantially flat opposite segments, between which the width of the shape is defined.

9. The thread according to claim 1, wherein the filaments are made from an organic material.

10. The thread according to claim 1, wherein the unitary body has a coating level that is comprised between 5 and 100%.

11. The thread according to claim 10, wherein the coating level of the unitary body is comprised between 5 and 50%.

12. The thread according to claim 11, wherein the filaments being made from aramid, the unitary body has a titer, expressed in dTex, and a maximum length of its oblong shape, expressed in millimeters, the value of the ratio between the titer and the maximum length being less than 1000.

13. A rigging sail, which includes two films made from a plastic material, which are laminated to each other and between which are inserted, in a superposition direction defined by the thickness of the films, both a reinforcing grid, which has a pre-established repetition pattern, and at least one individual reinforcing textile thread, which is oriented along a pre-determined line of action, wherein the at least one reinforcing thread is according to claim 1 and is arranged such that, in transverse cross-section, the width of the oblong shape of its unitary body extends along the superposition direction.

14. The sail according to claim 13, wherein the at least one reinforcing thread covers only a limited fraction of a facing surface of each of the two films, the facing surface of each of the two films being turned toward the other of the two films.

15. The sail according to claim 13, wherein the sail includes several reinforcing textile threads, at least two of which are partially superimposed along the superposition direction.

16. The sail according to claim 13, wherein the reinforcing grid is essentially made up of thread whereof the titer is substantially identical to that of the unitary body of the at least one reinforcing textile thread, the width of the oblong shape of the unitary body being at least two times smaller than the corresponding dimension of the threads of the reinforcing grid along the superposition direction.

17. A rigging, wherein the rigging includes a mainsail according to claim 13.

18. The thread according to claim 7, wherein the coating material making up the sheath has an acrylic, polyurethane or polyethylene base.

19. The thread according to claim 9, wherein the filaments are made from aramid, polyamide, polyester or polyethylene.

20. The thread according to claim 1, wherein the filaments are made from a mineral material.

21. The thread according to claim 20, wherein the filaments are made from carbon or glass.

22. The thread according to claim 1, wherein the coating material making up the cohesion binder is polymer-based.

23. The thread according to claim 22, wherein the coating material making up the cohesion binder has an acrylic, polyurethane or polyethylene base.

* * * * *